United States Patent [19]

Gall

[11] 3,938,563

[45] Feb. 17, 1976

[54] FUNNEL WITH AUTOMATIC AIR BLEEDING AND VALVED OUTLET

[76] Inventor: Kurt Gall, Welfenstrasse 22, 7 Stuttgart-Birkach, Germany

[22] Filed: June 24, 1974

[21] Appl. No.: 482,635

[30] Foreign Application Priority Data

June 26, 1973 Germany ..... 2332359
Aug. 4, 1973 Germany ..... 2339585

[52] U.S. Cl. ..... 141/298; 141/344
[51] Int. Cl.[2] ..... B65B 39/04
[58] Field of Search ..... 141/297, 298, 299, 300, 141/286, 331–335

[56] References Cited

UNITED STATES PATENTS

| | | | |
|---|---|---|---|
| 1,099,706 | 6/1914 | Lindeen | 141/298 |
| 1,942,282 | 1/1934 | Green | 141/298 |

*Primary Examiner*—Houston S. Bell, Jr.
*Attorney, Agent, or Firm*—Karl F. Ross; Herbert Dubno

[57] ABSTRACT

A funnel comprises a downwardly tapered generally frustoconical shell and a tube extending along the axis of the shell and having an open lower end adjacent the lower outlet of the shell and an upper end above the upper mouth of the shell. The tube is straight and is formed between its ends with a lateral opening. A pair of arms support a sleeve in the center of the shell which embraces the tube, this sleeve being formed with a downwardly extending skirt surrounding the tube at the level of the lateral opening. The tube is limitedly axially displaceable relative to the shell and is provided at its upper end with a handle engageable with the support sleeve and at its lower end with an upwardly tapered valve body sealingly engageable in the outlet of the funnel so as to prevent fluid flow therefrom. The funnel is filled with a liquid when the valve body is lifted up against the outlet, then the funnel is set on a vessel to be filled and the valve body and tube are lowered in order to allow the liquid to flow out of the outlet opening while allowing air in the vessel to escape upwardly through the tube. Liquid entrained by the upwardly rising air exits from the tube at the lateral opening and does not sprinkle the user.

7 Claims, 4 Drawing Figures

FUNNEL WITH AUTOMATIC AIR BLEEDING AND VALVED OUTLET

FIELD OF THE INVENTION

The present invention relates to a funnel. More particularly this invention concerns such a funnel which is provided with an air-bleeding tube and with a valve at its outlet.

BACKGROUND OF THE INVENTION

There is known a funnel which comprises a downwardly tapered frustoconical shell having at its lower end a narrow outlet and at its upper end a wide mouth. A tube is provided at the axis of this frustoconical shell and extends substantially through it such that its lower end projects beyond the outlet and its upper end above the mouth. This tube is slidable limitedly within the shell and is supported adjacent its upper end by a spider or the like. A handle is provided on the upper end of the tube and an upwardly tapered frustoconical valve body on the lower end so that when the handle is lifted the valve body blocks the outlet of the funnel, whereas when the handle is lowered fluid within the shell may flow out from the outlet thereof. During such filling operation air trapped within a vessel over which the shell is engaged may exit upwardly through the hollow tube.

It is known to provide a spring between the handle and the sleeve guiding and journaling the tube so as to urge the valve body into engagement with the outlet under normal conditions. The handle is formed with a bore in line with the central passage of the tube so that air bleeding out of the vessel being filled comes straight up.

A substantial disadvantage with such a structure is that a certain amount of liquid is entrained by the upwardly rising stream of air and is projected from the upper end of the tube. This problem is particularly bothersome when one is filling a vessel having a relatively narrow neck. A contributing factor to this problem is that the liquid that pours into the vessel forms a tubular screen around the valve body so that the air flowing upwardly through this body must inherently pass through this screen and therefore entrains a certain amount of liquid. When the liquid is an acid or other potentially dangerous substance this situation can constitute a relatively grave danger.

OBJECTS OF THE INVENTION

It is therefore an object of the present invention to provide an improved funnel. Another object is the provision of such a funnel which is safer to use than the above-described type.

Yet another object is to provide a funnel which is not likely to sprinkle the user with the liquid as it is being poured into a vessel.

SUMMARY OF THE INVENTION

These objects are attained according to the present invention by forming the bleeder tube between its ends with the lateral opening and providing a shield on the support which is spacedly adjacent the opening. Thus liquid entrained by the upwardly rising column of air is projected from the tube at the opening and is deflected by the shield back into the shell. Even if the upper end of the tube is left open the considerable decrease in velocity of the rising column of air as it reaches these lateral openings will effectively prevent the liquid from exiting from the upper end of the tube.

In accordance with another feature of this invention the frustoconical valve body provided at the lower end of the tube is formed at its lower end with an outwardly extending flange of circular axial projection and rectangular cross section. The diameter of this flange is greater than the inner diameter of the outlet opening at the bottom of the funnel so that liquid issuing therefrom is deflected radially outwardly and therefore broken up such that the chance of entraining this liquid is greatly decreased.

According to this invention the shield is constituted as a skirt formed on the lower side of a sleeve slidably receiving the tube and carried by two arms at the upper end or mouth of the frustoconical shell constituting the body of the funnel. The entire assembly is made of a synthetic resin such as a polycrylate like Nylon.

In the lowered position of the tube, that is with its handle resting against the top of the sleeve, the lateral opening according to this invention is below the sleeve and at the level of the skirt projecting downwardly therefrom.

According to yet another feature of this invention the cap or handle at the top of the vertically limitedly displaceable bleeder tube plugs or blocks the upper end of this tube so that all of the air bleeding out of the tube must pass through the lateral opening and any possibility that liquid be projected from the upper end of the tube through the handle onto the user is obviated.

The funnel according to the present invention therefore operates surely and eliminates the possibility that the liquid being introduced into a vessel or the like is sprinkled on the user. In spite of this additional safeguard the fabrication costs of the funnel are not increased, also liquid which otherwise often would be wasted by being projected completely away from the funnel is directed back into it.

BRIEF DESCRIPTION OF THE DRAWING

The above and other objects, features and advantages will become more readily apparent from the following description, reference being made to the accompanying drawing, in which.

SPECIFIC DESCRIPTION

Figure 1:
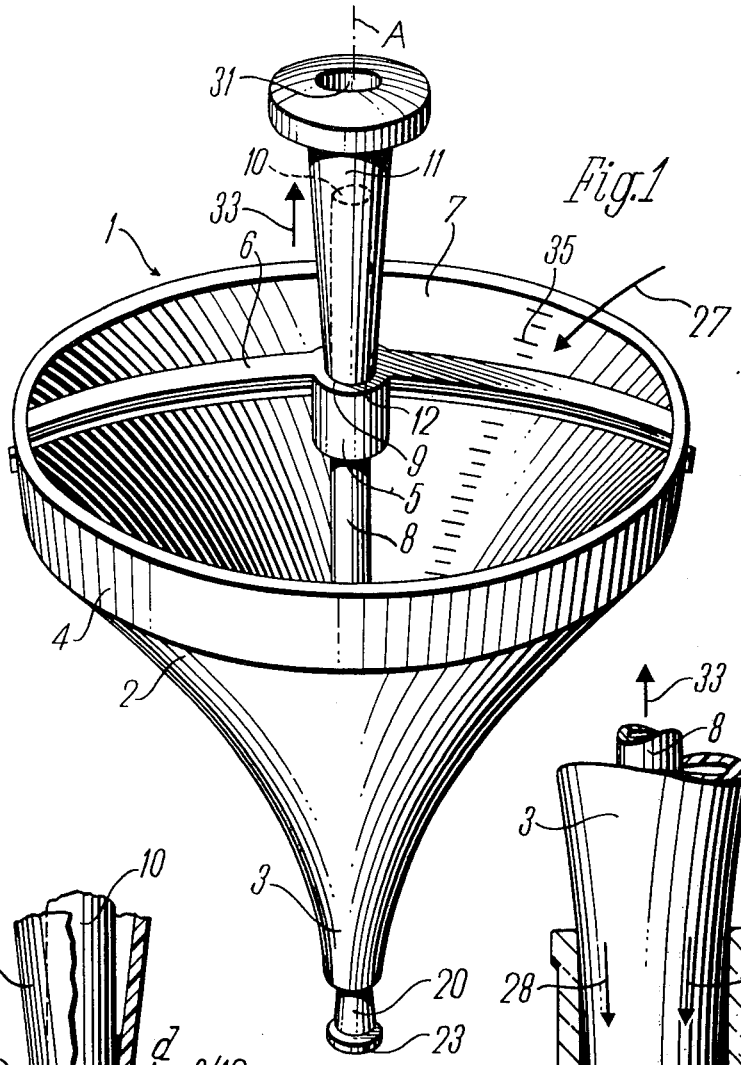
FIG. 1 is a perspective view of the funnel according to the present invention.

As shown in FIG. 1 a funnel 1 has a downwardly frustoconical shell 2 with a narrow lower end 3 and a wide upper mouth 4. A sleeve is aligned with the axis A of the shell 2 and is supported at the mouth 4 by a pair of arms 6 seated adjacent the upper rim 7 of the shell 2.

Figure 2:
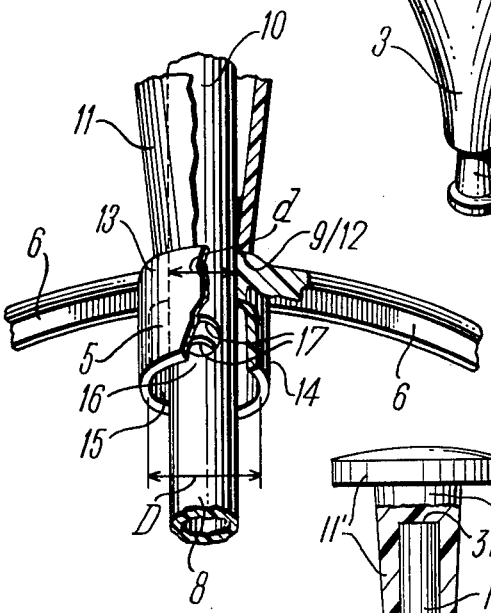
FIG. 2 is a large-scale and partly sectional view of detail of the funnel shown in FIG. 1.
Figure 3:
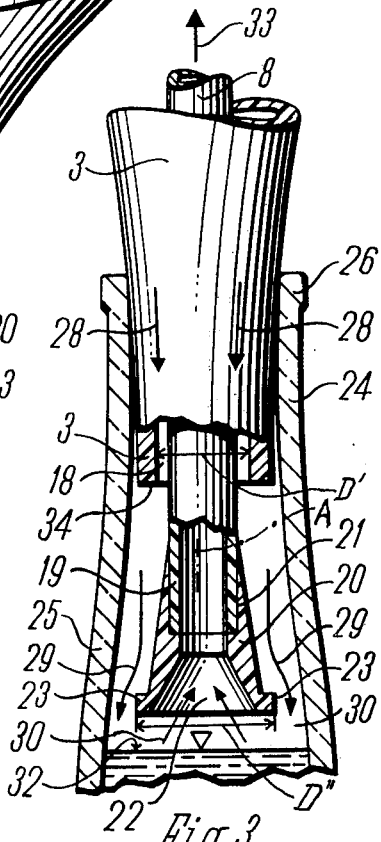
FIG. 3 is a largescale and partly sectional view illustrating the lower end of the funnel during a filling operation.

A hollow cylindrical tube 8 is fitted at its upper end 10 with a handle or cap 11 which rests with its lower edge 9 on the upper surface 12 of the sleeve 5 in the lowered position of the tube 8 illustrated in FIGS. 1–3.

As shown in FIG. 2 the sleeve 5 has an upper portion 13 which engages snugly about the tube 8 and has an inner diameter *d* which allows the tube to slide axially in this sleeve 5. In addition the sleeve has a lower section 14 whose inner wall 15 has a diameter D somewhat larger than the diameter *d*. In the lowered position of the tube 8 a pair of lateral openings 17 diametrically opposed at a region 16 of the tube 8 are below the sleeve portion 13 and at the level of the sleeve portion 14 for reasons which will be described below.

The lower end 3 of the shell 2 as shown in FIG. 3 has an inner wall 18 with a diameter D′ which is somewhat greater than the diameter *d* of the tube 8 so as to define a space therewith. This tube 8 carries at its lower end 19 an upwardly tapered frustoconical valve body 20 which is formed with a bore 21 that accepts this lower end 19 and is cemented thereto. The valve body 20 is formed with an outwardly flared frustoconical hole 22 in line with the passage extending through the tube 8. An outwardly extending rectangular-section flange at the lower end of the body 20 has an outer diameter D″ which is somewhat greater than the diameter D′.

When the lower end 3 is inserted past the rim 26 of the neck 24 of a bottle indicated at 25 in FIG. 3 it seals tightly therewith. Liquid is filled into the shell 2 as shown by arrow 27 and flows downwardly as indicated by arrows 28 through the lower end 3. The flange 23 deflects the liquid outwardly as shown by arrows 29 and air driven up in the bottle 25 comes up into the opening 22 as shown by arrows 30 and issues from the top of the tube through the hole 31 in the cap 11. Liquid entrained by the upwardly moving column of air will be expelled from the holes 17 and deflected by the shield or skirt 14 back into the funnel body.

When the liquid in the bottle 23 reaches the desired level 32 the handle is lifted upwardly in the direction of arrow 33 so as to raise the valve body 20 toward the lower rim 34 of the lower end 3 and thereby prevents further fluid flow out of the lower end 3.

A scale 35 is provided inside the funnel so as to allow the user to fill it to the desired level, and then decant its contents into a bottle or even to decant only a predetermined quantity. With the funnel according to the present invention it is possible to lift the entire arrangement from a bottle just filled without having to then deal with a dripping funnel that must quickly be moved to the next vessel.

Figure 4:
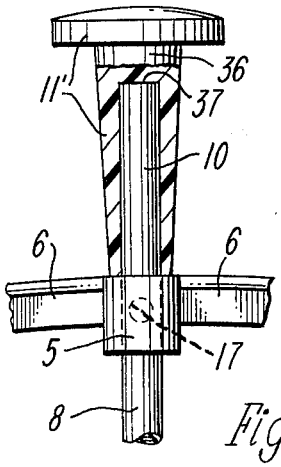
FIG. 4 is a large-scale view of a detail of an alternative arrangement according to the present invention.

As shown in FIG. 4 it is possible to provide the cap 11′ which has a solid handle portion 36 that blocks the upper end 37 of the tube 10 and only allows fluid flow out of the lateral openings 17 formed therein. Such an arrangement is useful with dangerous chemicals, such as acids, as it completely eliminates the possibility that the user will be sprinkled with the fluid.

I claim:

1. A funnel comprising:

a downwardly tapered shell having a narrow lower outlet and a wide upper mouth;

a tube extending substantially through said shell and having an open lower end adjacent said outlet and an upper end above said mouth, said tube being straight and formed between said ends with a lateral opening;

a support on said shell spanning said mouth holding said tube around said upper end thereof; and a downwardly extending tubular annular skirt on said support spacedly surrounding said tube at the level of said opening whereby fluid rising in said tube and issuing from said opening is deflected by said shield into said shell.

2. The funnel defined in claim 1, wherein said shell is a body of revolution having an axis, said tube lying on said axis and being limitedly axially displaceable, said funnel further comprising an upwardly tapered valve body at said lower end of said tube and engageable sealingly in said outlet in a lifted position of said tube.

3. The funnel defined in claim 2, further comprising a handle on said upper end of said tube above said sleeve and engageable therewith in a depressed position of said tube.

4. The funnel defined in claim 3 wherein said handle is formed with a throughgoing hole registering with the passage through said tube, whereby fluid in said tube can issue therefrom through said handle.

5. The funnel defined in claim 3 wherein said handle blocks said upper end of said tube, whereby fluid entering said lower end of said tube can leave said tube only through said opening.

6. The funnel defined in claim 3 wherein said valve body is formed with an outwardly directed fluid-deflecting flange extending substantially orthogonally from said axis.

7. The funnel defined in claim 3 wherein said valve body is formed with a downwardly flared opening communicating and aligned with the passage through said tube.

* * * * *